United States Patent [19]

Woollam et al.

[11] Patent Number: 4,686,907

[45] Date of Patent: Aug. 18, 1987

[54] LOW LEVEL FREIGHT CAR

[75] Inventors: Ronald F. Woollam, New Glasgow; Maurice L. MacDougall, Col. County, both of Canada

[73] Assignee: Hawker Siddeley Canada, Inc., Trenton, Canada

[21] Appl. No.: 796,709

[22] Filed: Nov. 12, 1985

[30] Foreign Application Priority Data

Jun. 26, 1985 [CA] Canada ..... 485270

[51] Int. Cl.[4] ..... B61D 3/14; B61D 3/18

[52] U.S. Cl. ..... 105/4.1; 105/416; 105/418; 105/419; 410/56

[58] Field of Search ..... 410/2–4, 410/54–57, 66; 105/3, 4 R, 355, 396, 404, 411, 413, 414, 415, 416, 418–420, 422, 4.1, 158.1, 158.2, 159, 238.1

[56] References Cited

U.S. PATENT DOCUMENTS

| | | | |
|---|---|---|---|
| 2,305,444 | 12/1942 | Pond . | |
| 2,489,024 | 11/1940 | Gaynor . | |
| 2,914,003 | 11/1959 | Seel et al. | 410/54 |
| 3,216,370 | 11/1965 | Kulieke . | |
| 3,260,223 | 7/1966 | Black et al. | 105/422 |
| 3,396,673 | 8/1968 | Livelsberger . | |
| 3,509,829 | 5/1970 | Henriksson et al. | 105/414 |
| 3,527,171 | 9/1970 | Stark | 105/413 |
| 4,274,776 | 6/1981 | Paton et al. | 410/3 |
| 4,452,147 | 6/1984 | Jwuc | 410/56 |
| 4,524,699 | 6/1985 | Pavlick | 105/4 R |

FOREIGN PATENT DOCUMENTS

| | | |
|---|---|---|
| 788744 | 7/1968 | Canada . |
| 812541 | 5/1969 | Canada . |
| 843151 | 6/1970 | Canada . |
| 850948 | 9/1970 | Canada . |
| 877696 | 8/1971 | Canada . |
| 910125 | 9/1972 | Canada . |
| 1056213 | 6/1979 | Canada . |
| 1070566 | 1/1980 | Canada . |
| 1109335 | 9/1981 | Canada . |
| 1122482 | 4/1982 | Canada . |
| 1135122 | 11/1982 | Canada . |
| 1177332 | 11/1984 | Canada . |
| 1183045 | 2/1985 | Canada . |

OTHER PUBLICATIONS

1970 Car and Locomotive Cyclopedia, p. 292 and pp. 552 and 553.

Jane's World Railways—15th Edition (1972–1973) pp. 65; 196–197; 236.

Jane's World Railways (1983–1984) pp. 153, 329 and 335.

1980 Car and Locomotive Cyclopedia at p. 499.

*Primary Examiner*—Randolph Reese

*Attorney, Agent, or Firm*—Robbins & Laramie

[57] ABSTRACT

A low-level freight car for carrying trailers and containers at a low overall height combines a low center sill with relatively light side sill assemblies to provide a rigid structure having low deflection characteristics under the expected buff, draft and vertical load combinations, while keeping overall tare weight to reasonable levels and providing an adequate safety factor.

17 Claims, 9 Drawing Figures

LOW LEVEL FREIGHT CAR

BACKGROUND OF THE INVENTION

This invention relates to a low level freight car for carrying trailers and containers and particularly to a low level freight car adapted for intermodal use.

The prior art has provided a variety of low level freight cars adapted to carry trailers, etc. in "piggy back" fashion. In order to clear bridges and tunnels, various types of low level flat bed and well cars have been designed. Certain of these designs, such as shown in the Budd U.S. Pat. No. 4,456,413, employ a pair of spaced side sill assemblies which accommodate buff and draft forces while also supporting a floor structure which carries vertical loadings applied by the trailer or container. The underframe structure in the lighter designs may be subject to excessive deflection under load, while in the low-deflection designs, excessive tare weight due to the heavy sill structure needed may pose a problem. Hence there is a need for an improved low-level, low deflection, relatively low-tare weight freight car for transporting trailers, containers and the like. There is also a need to provide cars of this variety which are capable of intermodal use, the cars being articulated together by special connectors, known as such, with adjacent ends of the cars sharing a single truck to make full use of axle loading capacity and thereby keeping tare weight down.

SUMMARY OF THE INVENTION

Accordingly, the present invention provides a low-level freight car for carrying trailers and containers at a low overall height, which freight car combines a low center sill with relatively light side sill assemblies to provide a rigid well car structure having low deflection characteristics under the expected buff, draft and vertical load combinations, while keeping overall tare weight to reasonable levels and providing an adequate safety factor. This is achieved by providing for a suitable sharing of the applied forces and loadings between the center sill and the side sill assemblies. Suitable end frame structures ensure that buff and draft forces applied to the center sill end portions are in part transmitted to the side sill assemblies and hence shared between the latter and the center sill while at the same time vertical loadings applied to the floor structure are transmitted laterally and shared between the side sill and center sill assemblies. The judicious use of shear plates assists in the load sharing function while also reducing stress concentration problems.

The freight cars of the invention are preferably designed for intermodal use and are thus provided with special connector assemblies whereby intermediate cars share a single truck at adjacent ends thereby to keep tare weight down to reasonably low levels.

Freight cars according to the invention are capable of carrying a wide variety of lengths of trailer e.g. from 40 to 48 feet with nose mounted refrigeration units. The design is such that the load carrying well region of the car is relatively long compared to the overall car length i.e. there is relatively little waste space at the opposing ends of the car.

Other features and advantages of the invention will become apparent from the following description of a preferred embodiment of the invention taken in conjunction with the appended claims.

DETAILED DESCRIPTION OF PREFERRED EMBODIMENTS

Figure 1:
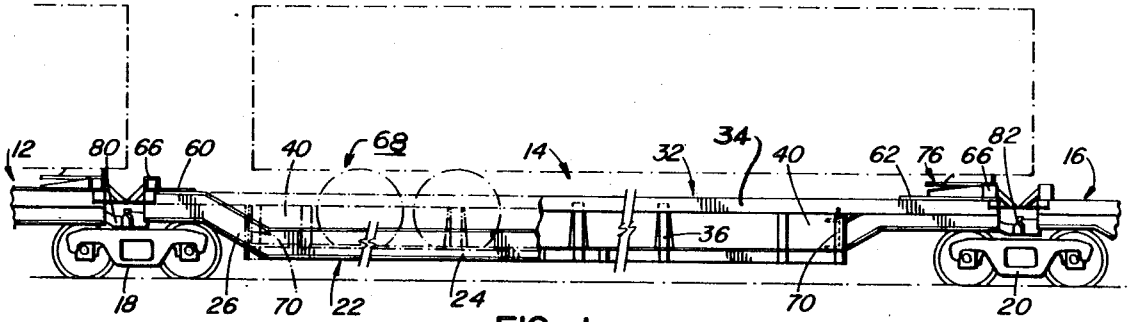
FIG. 1 is a side elevation view of a freight car connected between adjacent freight cars in an articulated intermodal configuration with each truck being shared between adjacent cars.
Figure 2:
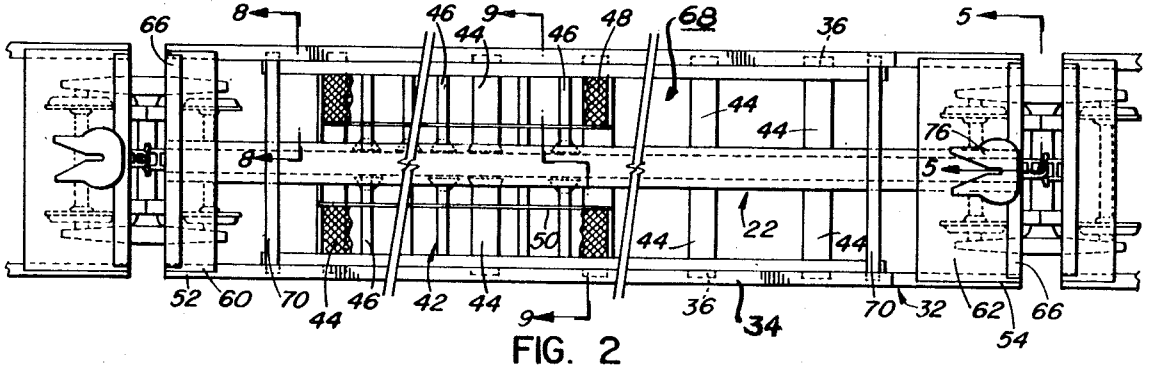
FIG. 2 is a top plan view of the freight car of FIG. 1.
Figure 5:
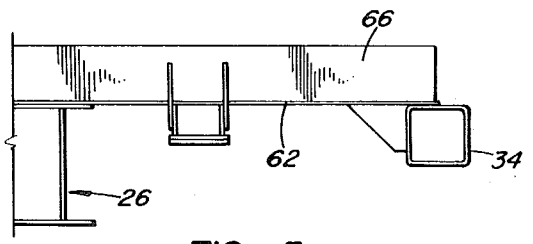
FIG. 5 is a cross-section view taken along line 5—5 of FIG. 2.
Figure 6:
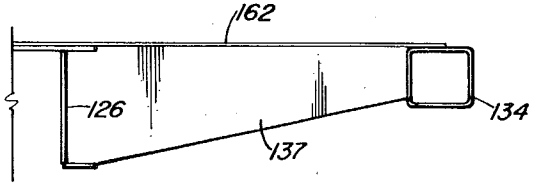
FIG. 6 is a cross-section view taken along line 6—6 of FIG. 4.
Figure 3:
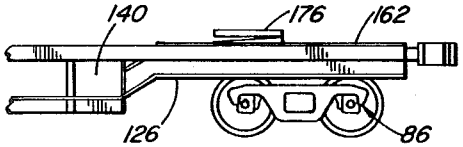
FIG. 3 is a side view of the end portion of an alternative version of the freight car.
Figure 4:
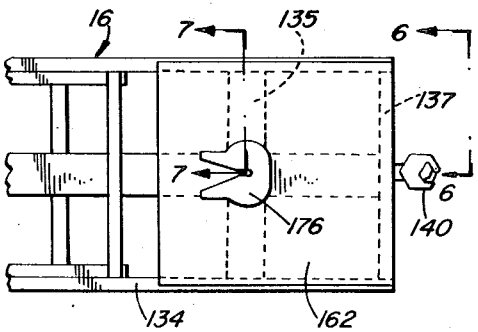
FIG. 4 is a top plan view of the car of FIG. 3.
Figure 8:
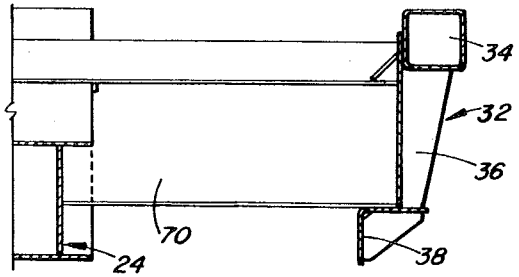
FIG. 8 is a cross-section view taken along line 8—8 of FIG. 2.
Figure 7:
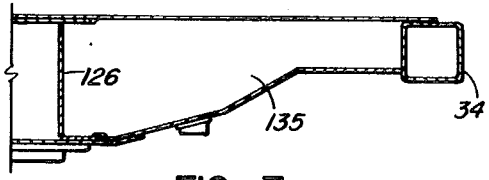
FIG. 7 is a cross-section view taken along line 7—7 of FIG. 4.

Referring now to the drawings there are shown in FIGS. 1 and 2, in part, freight cars 12, 14 and 16 each carrying a trailer (shown in phantom) in "piggy back" fashion. The adjacent ends of cars 12 and 14 share a common truck 18 while the adjacent ends of cars 14 and 16 are supported by the shared truck 20. Since the cars are of identical or similar structure only car 14 will be described in detail.

Figure 9:
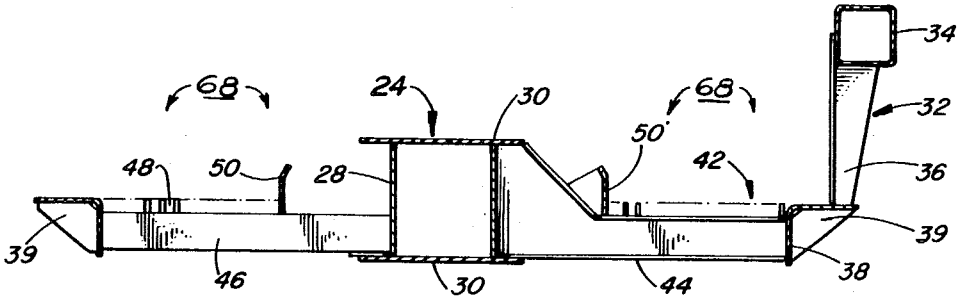
FIG. 9 is a cross-section view taken along line 9—9 of FIG. 2.

Car 14 includes a center sill 22 extending along its longitudinal center line. Center sill 22 includes a straight, low level or depressed intermediate section 24 and opposing raised end sections 26, each having a goose neck configuration. As best seen in FIG. 9, center sill 22 is of a box beam configuration and includes spaced side webs 28 and top and bottom cover plates 30, both securely welded to the side webs to provide what is, in effect, a sturdy load bearing beam.

A pair of side sill assemblies 32, which extend the full length of center sill 22, are disposed in spaced flanking relationship to center sill 22. Each side sill assembly includes a straight top side tube 34 of rectangular section, which is connected at spaced intervals by tapered vertical side posts 36 to a bottom side angle member 38, the latter being generally co-extensive with center sill intermediate section 24. Because of the relatively large effective depth of the side sill assemblies 34 they possess substantial beam strength. The spaces between posts 36 are preferably left open, to reduce weight, but adjacent the opposing ends of the car, between the last two posts 36, there are provided rectangular steel plates 40. Plates 40, rigidly welded in position, help to ensure that some of the buff and draft forces applied to top side tube 34 are transmitted into the bottom side angle member 38.

The low-level car floor structure 42 includes a series of spaced apart lateral members connected between the depressed intermediate section 24 of the center sill 22 and the bottom side member 38. These lateral members include a series of transverse cross bearer beams 44, generally I-shaped in cross-section and having deep inner portions adapted to be securely welded in abutting relation to the full height of the center sill section 24. The outer end of each cross bearer 44 is securely welded in abutting relation to the inner face of bottom side member 38. The vertical side posts 36 are located in the same vertical planes as the associated cross bearer members 44. These cross bearers 44 are the main structural ties between the center sill section 24 and the side sill assemblies 32. However, approximately one half of the floor structure is provided with an added series of cross tubes 46, each of rectangular cross-sectional shape, and each welded in abutting relation to the center sill section 24 and bottom side member 38. Gusset plates 39 strengthen member 38 at each point of connection of the lateral members thereto. As shown, a spaced pair of such tubes 46 is located between each pair of cross bearers 44. This portion of the floor structure, which extends from adjacent one end of the car to about the mid-point of the car, also includes a load supporting platform 48, in the form of a steel grating or floor plate disposed on the cross bearers 44 and cross tubes 46, which platform receives and supports the rear wheels of the trailer. Platform 48 is made sufficiently long as to accommodate a desired range of lengths of trailers. A pair of wheel guide plates 50 (FIGS. 2 and 9) serve to center the trailer relative to the car.

End frame assemblies 52, 54 at opposing ends of the car interconnect the center sill end sections 26 to the side sill assemblies 32. Each end frame assembly includes a horizontal shear plate 60, 62, with shear plate 62 being wider than its counterpart at the opposite end of the car. The shear plates are firmly welded to the center sill end sections 26 and to the top side tubes 34 of the side sill assemblies. Buff and draft forces applied to the end sections 26 thus are, in part, transmitted outwardly via the shear plates to the top side tubes with the result being that such forces are shared between the center sill and side sill assemblies. In order that vertical loadings may be transmitted between the center sill and side sill assemblies, a stiffener tube 66 of rectangular cross section extends transversely of the car at each of the extreme opposing ends thereof and is welded firmly to its associated shear plate 60, 62, the latter being firmly welded to the center sill and side sill assemblies in order that vertical loadings may be shared between them. A further load sharing and stabilizing function is carried out by transverse channels 70 which are secured between the side sill assemblies 32 and the center sill end sections 26 adjacent each of the opposing ends of the car 14.

The upper extremities of the side sill assemblies 32 (i.e. top side tubes 34), as shown in the drawings, are disposed at a level substantially above the level of the center sill depressed intermediate section 24 to define, together with low level floor structure 42 and the opposing end frame assemblies 52, 54, an elongated lengthwise extending cargo well 68 for receiving trailers or containers.

In order to secure the trailer firmly to car 14, a conventional fifth wheel hitch 76 is mounted above shear plate 62 closely adjacent to the end of the car and centered with the center sill end section 26. Vertical loadings are thus applied to end section 26 and are thence transmitted to the adjacent coupler and the shared truck.

It will be noted that adjacent ends of cars 12, 14 and 16 are supported by shared trucks 18 and 20. Trucks 18 and 20 are of a conventional design and they are adapted to receive and support coupling assemblies 80 and 82 which are rigidly affixed to the extreme outer ends of the center sill end sections 26. These coupling assemblies include male and female connector elements connected to the same central pin connection so as to permit adjacent freight car units to move about the same common central point on the trucks. One suitable form of articulated connector is that made by American steel foundries, Chicago, Ill., U.S.A. and often referred to as the AMSTEAD coupler.

Car 14 which has just been described has shared trucks at both opposing ends. In a five car articulated intermodal arrangement, three intermediate cars exactly as car 14 described above are required. The two end cars are slightly differently constructed in that the outer end of each is provided with a non-shared truck as well as a standard coupling. Reference may be had to FIGS. 3, 4, 6 and 7 which shows the opposing end of car 16 with its own truck 86. The frame configuration is similar to that described above, the main difference being that the frame end structure is considerably longer as compared with that of car 14. The end structure includes a shear plate 162 welded firmly to the top side tubes 134 of the side sill assemblies 132, as well as to the upper surface of the center sill end section 126 and to a pair of lateral beams 135 (FIG. 7) commonly known as car body bolsters, the latter having their inner ends welded to the center sill end section 126 and their outer ends secured to top side tubes 134. Loadings applied to the fifth wheel 176 are transmitted down through the center sill end section and into the bolster of truck 86, which is vertically aligned with such fifth wheel. At the extreme outer end, tapered lateral frame members 137 (FIG. 6) are welded to the end section 126 of the center sill, to shear plate 162 and upper side edge tube 134 thereby assisting in providing the desired degree of rigidity to the structure. A standard car coupler 140 is mounted in the outermost end of the center sill end section 126. Since this component is of a conventional design, no further description of it is considered necessary.

By virtue of the configuration described, buff and draft forces are shared between the side sill assemblies and the center sill. This force sharing need not be on a 50-50 basis; rather, the force sharing ratio may be varied considerably depending on the exact design, the main idea being to provide a structure having sufficient strength coupled with low deflection characteristics and relatively low tare weight. The vertical loading transmitted via the trailer wheels is applied to the lateral cross bearers and the lateral tubes and the vertical loading is thus shared between the center sill and side sill assemblies. The side sill loadings are ultimately transmitted back to the center sill end section via the end stiffener tubes described above in connection with the first embodiment and also, in the case of the second embodiment, by the lateral frame members 135 and end sill 137.

Further, because of the low-level nature of the floor structure, the overall height of the car together with its load is made sufficiently low that it can clear bridges and tunnels etc. which were previously off limits. The articulated intermodal configuration also leads to further improvements in operation including operating cost savings as will be easily appreciated by those skilled in the art.

We claim:

1. A low-level freight car comprising:

(a) a center sill extending the full length of the car and having a depressed low-level intermediate section and opposing raised end sections having a gooseneck configuration;

(b) a pair of side sill assemblies each of substantial depth and beam strength disposed in spaced flanking relation to said center sill;

(c) a low-level floor structure including a plurality of spaced lateral members connected between said low-level depressed center sill intermediate section and lower portions of each of said side sill assemblies for supporting at least a portion of the vertical loadings produced by a load being carried by the freight car in such a manner that these vertical loadings are transmitted via said lateral members to both said center sill intermediate section and to said side sill assemblies so that these vertical loadings are shared between them;

(d) end frame structures at opposing ends of the car interconnecting the center sill raised end sections to said side sill assemblies such that longitudinal buff and draft forces applied to said center sill end sections are in part transmitted to said side sill assemblies whereby such longitudinal forces are also shared between said center sill and the side sill assemblies;

(e) the side sill assemblies having upper extremities which are located at a level substantially above the level of said low-level center sill intermediate section to define together with said low level floor structure and said end frame structures an elongated well for receiving cargo.

2. The freight car of claim 1 wherein said upper extremity of each said side sill assembly comprises an elongated top side member and said lower portion of each side sill assembly comprises an elongated bottom side member in spaced parallel relation to said top side member.

3. The freight car of claim 2 wherein said spaced lateral members are disposed in generally co-planar relationship with one another and have their outer ends connected to said bottom side member and their inner ends connected to said center sill intermediate section and a platform disposed on a plurality of said lateral members for receiving the load carried by the freight car, and a plurality of spaced apart vertical posts interconnected between said top side member and bottom side member.

4. The freight car according to claim 2 wherein said end frame structure includes a shear plate extending the width of the car at each end thereof and each affixed to a respective center sill end section and to the opposing side sill assemblies, the end frame structure further including a transverse stiffener member at each end of the car for transmitting vertical loadings inwardly from the side sill assemblies to said center sill.

5. The freight car according to claim 4 wherein said spaced lateral members comprise spaced apart transverse cross bearers having inner ends welded to the center sill intermediate section and outer ends welded to said bottom side member of the side sill assembly, and a platform supported on a plurality of said lateral members including a grating or floor plate extending part way along the length of said car and a plurality of additional lateral members in the form of tubes located intermediate said cross bearers in the region of the grating or floor plate to provide additional support therefor.

6. The freight car according to claim 4 wherein said side sill assemblies are co-extensive with said center sill.

7. The freight car according to claim 2 wherein said bottom side members are generally co-extensive with said center sill depressed intermediate section, and side panel means extending between and affixed to said top side member and bottom side member adjacent the opposing ends of the latter to assist in spreading buff and draft forces to both the top and bottom side members.

8. The freight car according to claim 1 wherein said end frame structure includes a shear plate extending the width of the car at each end thereof and each affixed to a respective center sill end section and to the opposing side sill assemblies to distribute the buff and draft loadings between said center sill and side sill assemblies.

9. The freight car according to claim 8 wherein said end frame structure includes stiffening means for transmitting vertical loadings from the side sill assembly inwardly at the car ends to the center sill end sections from whence such vertical loadings may be transmitted to a truck bolster.

10. The freight car according to claim 1 including coupling means mounted to opposing ends of the center sill.

11. The freight car according to claim 1 including coupling means mounted to opposing ends of the center sill, and wheeled trucks supporting each end of the car and at least one next adjacent freight car.

12. A multi-car intermodal assembly in accordance with claim 1, and including a pair of opposed end cars and at least one intermediate car, the latter having a wheeled truck at each of its ends, both of which trucks also support an end of the car next adjacent thereto, and coupling means articulating such cars together and secured to said trucks.

13. A low-level freight car comprising:

(a) a center sill extending the full length of the car and having a depressed low-level intermediate section and opposing raised end sections having a gooseneck configuration;

(b) a pair of side sill assemblies disposed in spaced flanking relation to said center sill;

(c) low-level floor structure including a plurality of spaced lateral members connected between said low-level depressed center sill intermediate section and lower portions of each of said side sill assemblies and a platform located on a plurality of said lateral members for supporting at least a portion of a load being carried by the freight car and transmitting such loadings via said lateral members to both said center sill intermediate section and to said side sill assemblies;

(d) end frame structures at the opposing ends of the car interconnecting the center sill raised end sections to said side sill assemblies such that buff and draft forces applied to said center sill end sections are in part transmitted to said side sill assemblies whereby such forces are shared between said center sill and the side sill assemblies;

(e) each said side sill assembly comprising an elongated top side tube and an elongated bottom side member in spaced parallel relation to said top side tube, and a plurality of spaced apart vertical posts interconnected between said top side tube and bottom side member;

(f) said top side tubes of the side sill assemblies being located at a level substantially above the level of said low level center sill intermediate section to define, together with said low-level floor structure and said end frame structures, an elongated well extending lengthwise of said car for receiving cargo;

(g) said spaced lateral members comprising spaced apart transverse co-planar cross bearers having inner ends welded to the center sill intermediate section and outer ends welded to the bottom side member of the side sill assembly, said platform including a grating or floor plate extending lengthwise of said car and a plurality of additional lateral members in the form of tubes located intermediate said cross bearers in the region of the grating or floor plate to provide additional support therefor; and (h) said end frame structures including a shear plate extending the width of the car at each end thereof and each affixed to a respective center sill end section and to the opposing side sill assemblies, the end frame structures further including a transverse stiffener member at each end of the car of transmitting vertical loadings inwardly from the side sill assemblies to said center sill.

14. The freight car according to claim 13 wherein said bottom side members are generally co-extensive with said center sill depressed intermediate section, and side panel means extending between and affixed to said top side tube and bottom side member adjacent the opposing ends of the latter.

15. The freight car according to claim 13 including coupling means mounted to opposing ends of the center sill.

16. The freight car according to claim 13 including coupling means mounted to opposing ends of the center sill, and wheeled trucks supporting each end of the car and at least one next adjacent freight car.

17. A multi-car intermodal assembly in accordance with claim 13, and including a pair of opposed end cars and at least one intermediate car, the latter having a wheeled truck at each of its ends, both of which trucks also support an end of the car next adjacent thereto, and coupling means articulating such cars together and secured to said trucks.

* * * * *